US008758886B2

(12) United States Patent
Koenig et al.

(10) Patent No.: US 8,758,886 B2
(45) Date of Patent: Jun. 24, 2014

(54) RECORDING SHEET WITH IMPROVED IMAGE DRY TIME

(75) Inventors: Michael F Koenig, Loveland, OH (US); Sen Yang, Mason, OH (US); Steve Schultz, Cincinnati, OH (US); John Stoffel, San Diego, CA (US); Hai Tran, San Diego, CA (US); Ronald Askeland, San Diego, CA (US); William R Sperry, San Diego, CA (US); Lawrence Gibson, San Diego, CA (US); Richard Robert Hartman, Memphis, TN (US)

(73) Assignee: International Paper Company, Memphis, TN (US)

( * ) Notice: Subject to any disclaimer, the term of this patent is extended or adjusted under 35 U.S.C. 154(b) by 891 days.

(21) Appl. No.: 11/251,332

(22) Filed: Oct. 14, 2005

(65) Prior Publication Data

US 2007/0087138 A1 Apr. 19, 2007

(51) Int. Cl.
*B41M 5/00* (2006.01)

(52) U.S. Cl.
USPC ..... 428/211.1; 428/219; 428/533; 428/537.7; 162/176; 162/181.2

(58) Field of Classification Search
USPC ..... 428/32.18, 195.1, 211.1, 219, 533, 428/537.7; 162/135, 175, 181.2, 176
See application file for complete search history.

(56) References Cited

U.S. PATENT DOCUMENTS

| | | | | |
|---|---|---|---|---|
| 3,293,114 | A | | 12/1966 | Kenaga et al. |
| 3,533,908 | A | | 10/1970 | Hoogsteen |
| 3,556,934 | A | | 1/1971 | Meyer |
| 3,600,385 | A | | 8/1971 | Loffelman |
| 3,719,514 | A | | 3/1973 | Taylor |
| 3,956,283 | A | | 5/1976 | Fleck |
| 4,040,900 | A | | 8/1977 | Mazzarella et al. |
| 4,133,688 | A | | 1/1979 | Sack |
| 4,251,824 | A | | 2/1981 | Hara et al. |
| 4,279,794 | A | | 7/1981 | Dumas |
| 4,381,185 | A | | 4/1983 | Swanson et al. |
| 4,410,899 | A | | 10/1983 | Haruta et al. |
| 4,412,224 | A | | 10/1983 | Sugitani |
| 4,483,889 | A | | 11/1984 | Andersson |
| 4,532,530 | A | | 7/1985 | Hawkins |
| 4,554,181 | A | | 11/1985 | Cousin et al. |
| 4,601,777 | A | | 7/1986 | Hawkins et al. |
| 4,717,502 | A | | 1/1988 | Schmid |
| 4,721,655 | A | | 1/1988 | Trzasko |
| 4,740,420 | A | | 4/1988 | Akutsu et al. |
| 4,781,985 | A | * | 11/1988 | Desjarlais ..... 428/421 |
| 4,900,620 | A | | 2/1990 | Tokita et al. |
| 5,125,996 | A | | 6/1992 | Campbell et al. |
| 5,198,023 | A | | 3/1993 | Stoffel |
| 5,288,690 | A | | 2/1994 | Warner et al. |
| 5,380,361 | A | | 1/1995 | Gill |
| 5,401,562 | A | | 3/1995 | Akao |
| 5,429,860 | A | | 7/1995 | Held et al. |
| 5,472,485 | A | | 12/1995 | Pandian et al. |
| 5,514,429 | A | | 5/1996 | Kamihgaraguchi et al. |
| 5,522,968 | A | | 6/1996 | Kuroyama et al. |
| 5,547,822 | A | | 8/1996 | Noda et al. |
| 5,620,793 | A | | 4/1997 | Suzuki et al. |
| 5,695,820 | A | | 12/1997 | Davis et al. |
| 5,851,651 | A | * | 12/1998 | Chao ..... 428/327 |
| 6,123,760 | A | | 9/2000 | Varnell |
| 6,162,328 | A | | 12/2000 | Cenisio et al. |
| 6,207,258 | B1 | * | 3/2001 | Varnell ..... 428/32.1 |
| 6,266,414 | B1 | | 7/2001 | Bradley et al. |
| 6,268,414 | B1 | | 7/2001 | Lin |
| 6,348,132 | B1 | | 2/2002 | Zhang et al. |
| 6,359,040 | B1 | | 3/2002 | Burdick |
| 6,372,035 | B1 | | 4/2002 | Juppo et al. |
| 6,406,594 | B1 | | 6/2002 | Palmer et al. |
| 6,485,139 | B1 | | 11/2002 | Lavery et al. |
| 6,660,347 | B2 | | 12/2003 | Steiger |
| 6,686,054 | B2 | | 2/2004 | Nigam |
| 6,761,977 | B2 | | 7/2004 | Nigam |
| 6,764,726 | B1 | * | 7/2004 | Yang et al. ..... 428/32.18 |
| 6,841,109 | B2 | | 1/2005 | Tsubaki et al. |
| 6,880,928 | B2 | | 4/2005 | Hosoi et al. |
| 6,994,734 | B2 | | 2/2006 | Yamaguchi et al. |
| 7,582,188 | B2 | | 9/2009 | Stoffel et al. |
| 8,012,551 | B2 | | 9/2011 | Song et al. |
| 8,123,907 | B2 | | 2/2012 | Stoffel et al. |

(Continued)

FOREIGN PATENT DOCUMENTS

| | | |
|---|---|---|
| EP | 0181646 | 5/1986 |
| EP | 0629741 | 12/1994 |

(Continued)

OTHER PUBLICATIONS

Tappi Journal article by S.R. Boone, Feb. 1996, p. 122.
The Sizing of Paper, 2nd Edition, by W.F. Reynolds, Tappi Press 1989, pp. 1-33.
C.E. Farley & R.B. Wasser, the Sizing of Paper, 2nd Edition, W.F. Reynolds, Tappi Press, 1989, pp. 51-62.
Handbook for Pulp & Paper Technologies, 2nd Edition, G.A. Smook, Angus Wilde Publications 1992.
Quantitative Determination of Alkyl Ketene dimer (AKD) retention in Paper made on a Pilot Paper Machine, p. 253-260.

(Continued)

*Primary Examiner* — Gerard Higgins
(74) *Attorney, Agent, or Firm* — Thomas W. Barnes, III; Eric W. Guttag

(57) ABSTRACT

This invention is directed to an recording sheet having improved image dry time for use in printing comprising a substrate having in contact with at least one surface thereof one or more water soluble divalent metal salts, preferably admixed with one or more starches, to process of forming such recording sheet, to a method of generating one or more image(s) on said recording sheet in an printing process and to a recording sheet having one or more images on a surface thereof.

16 Claims, 3 Drawing Sheets

(56) References Cited

U.S. PATENT DOCUMENTS

| | | | | |
|---|---|---|---|---|
| 8,256,887 | B2 | 9/2012 | Zhou et al. | |
| 2003/0098903 | A1 * | 5/2003 | Perchak et al. | 347/98 |
| 2003/0227531 | A1 | 12/2003 | Hosoi et al. | |
| 2005/0124755 | A1 | 6/2005 | Mitchell | |
| 2006/0051528 | A1 | 3/2006 | Ogino | |
| 2006/0254738 | A1 | 11/2006 | Anderson | |
| 2007/0087138 | A1 | 4/2007 | Koenig et al. | |
| 2008/0098931 | A1 | 5/2008 | Skaggs et al. | |
| 2009/0266501 | A1 | 10/2009 | Stoffel et al. | |
| 2009/0274855 | A1 | 11/2009 | Koenig et al. | |
| 2009/0295892 | A1 | 12/2009 | Akiyama | |
| 2009/0317549 | A1 | 12/2009 | Tan et al. | |
| 2009/0320708 | A1 | 12/2009 | Jackson et al. | |
| 2010/0129553 | A1 | 5/2010 | Jackson et al. | |
| 2010/0163201 | A1 | 7/2010 | Kim et al. | |
| 2011/0151148 | A1 | 6/2011 | Koenig et al. | |
| 2011/0151149 | A1 | 6/2011 | Koenig | |
| 2011/0168343 | A1 | 7/2011 | Jackson et al. | |
| 2011/0240241 | A1 | 10/2011 | Koenig et al. | |
| 2011/0240242 | A1 | 10/2011 | Koenig et al. | |
| 2011/0274856 | A1 | 11/2011 | Koenig et al. | |
| 2012/0019587 | A1 | 1/2012 | Koenig | |
| 2012/0121872 | A1 | 5/2012 | Koenig | |

FOREIGN PATENT DOCUMENTS

| | | |
|---|---|---|
| EP | 0652324 | 5/1995 |
| EP | 0666368 | 8/1995 |
| EP | 0747235 | 12/1996 |
| EP | 1036666 | 9/2000 |
| EP | 1079356 | 2/2001 |
| EP | 1122085 | 8/2001 |
| EP | 1153761 | 11/2001 |
| EP | 1355004 | 10/2003 |
| EP | 0999937 | 2/2005 |
| EP | 1566281 | 8/2005 |
| EP | 1571149 | 9/2005 |
| EP | 1712677 | 10/2006 |
| EP | 1743976 | 1/2007 |
| EP | 1775141 | 4/2007 |
| EP | 1947240 | 7/2008 |
| GB | 786543 | 10/1955 |
| GB | 903416 | 11/1959 |
| GB | 1373788 | 10/1972 |
| GB | 1533434 | 3/1976 |
| GB | 2307487 | 5/1997 |
| JP | 10166715 | 6/1998 |
| JP | 2006168017 | 6/2000 |
| JP | 2000263918 | 9/2000 |
| JP | 2000280613 | 10/2000 |
| JP | 2001328340 | 11/2001 |
| JP | 2002274012 | 9/2002 |
| JP | 2004245593 | 9/2004 |
| JP | 2004255593 | 9/2004 |
| WO | 9609345 | 3/1996 |
| WO | 9635841 | 11/1996 |
| WO | WO 99/06219 | 2/1999 |
| WO | 9916973 | 4/1999 |
| WO | 02060883 | 8/2002 |
| WO | 03044275 | 5/2003 |
| WO | 03078175 | 9/2003 |
| WO | 2005115763 | 12/2005 |
| WO | 2006049545 | 5/2006 |
| WO | 2006110751 | 10/2006 |
| WO | 2007053681 | 5/2007 |
| WO | 2007141271 | 12/2007 |
| WO | 2008017623 | 2/2008 |
| WO | 2008055858 | 5/2008 |
| WO | 2009110910 | 9/2009 |
| WO | 2009124075 | 10/2009 |
| WO | 2009146416 | 12/2009 |

OTHER PUBLICATIONS

Tracing Tecnique in Geohydrology by Werner Kass and Horst Behrens, published by Taylor Francis, 1998, pp. 48-55.

Sythetic Detergents in the Soap Industry Lime Soap Dispersion Test, H.C. Borghetty et al., J. Am. Oil, Chem. Soc., 27,88-90 1950.

Lipids in Cereal Staraches: A Review; William R. Morrison; Jounal of Cereal Science 8 1988, pp. 1-15.

BeMiller et al., Starch, Ullmann's Encyclopedia of Industrial Chemistry, vol. 34, pp. 113-117. online, John Wiley Sons, Inc. 2011 Retrieved on May 16, 2012, Retrieved from Internet: URL http:onlinelibrary.wiley.com/doi,10.1002,14356007. a25_001. pub4/full.

High Solids Modified Calcium Carbonates A Concept for Inkjet Papers, Varney Kukkamo, May 2010.

Pigment Coating Techniques, Chapter 24, p. 415-417, Jukka Linnonmaa and Michael Trefz.

Automataic Color recognition System for Stockigt Sizing Test (II), Journal of Korea TAPPI, 37(1):73-81, 2005.

Paper and board—Determination of sizing—Stoeckigt method, JIS P 8122: 2004, rev. Mar. 20, 2004, published by Japanese Standards Association.

* cited by examiner

Figure 1. Dry Time (HP 6122, Pigment Black ink) vs HST
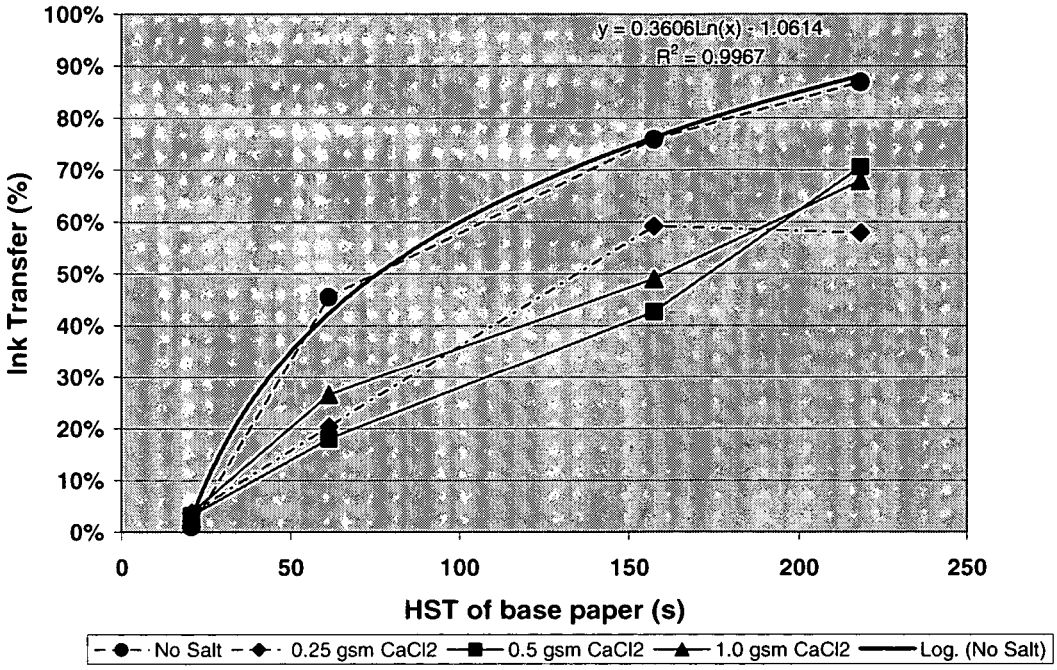
Figure 2. Dry Time (HP 6122) vs CaCl2 coverage
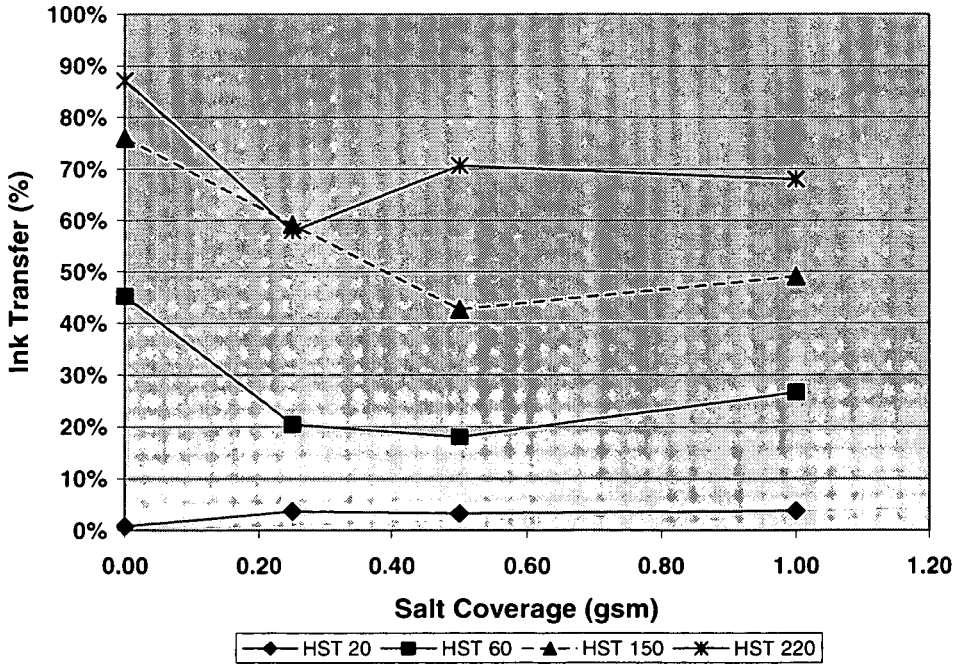

Figure 3. Black Density (HP 6122, Pigment Black ink) vs HST
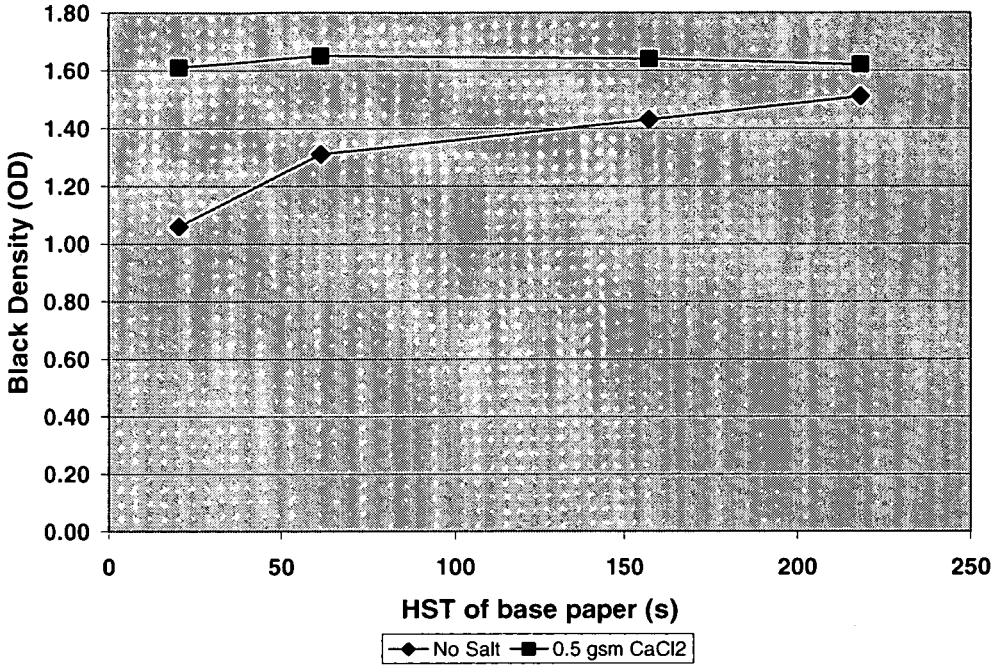
Figure 4. Pigment Black OD (HP 6122) vs CaCl2 coverage
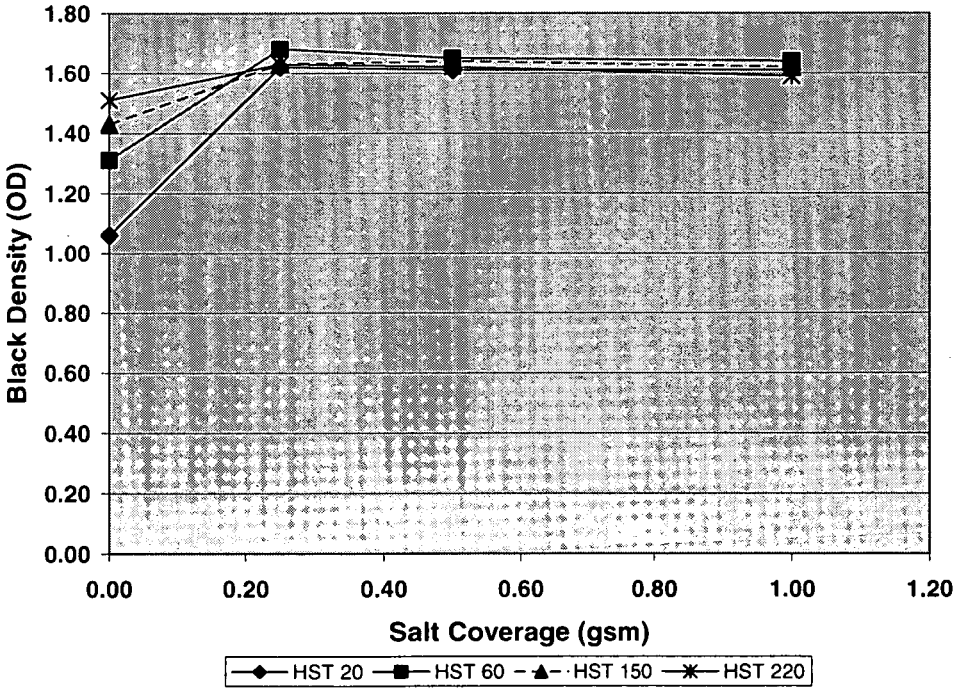

Figure 5. Edge Acuity (HP 6122, Pigment Black ink) vs HST
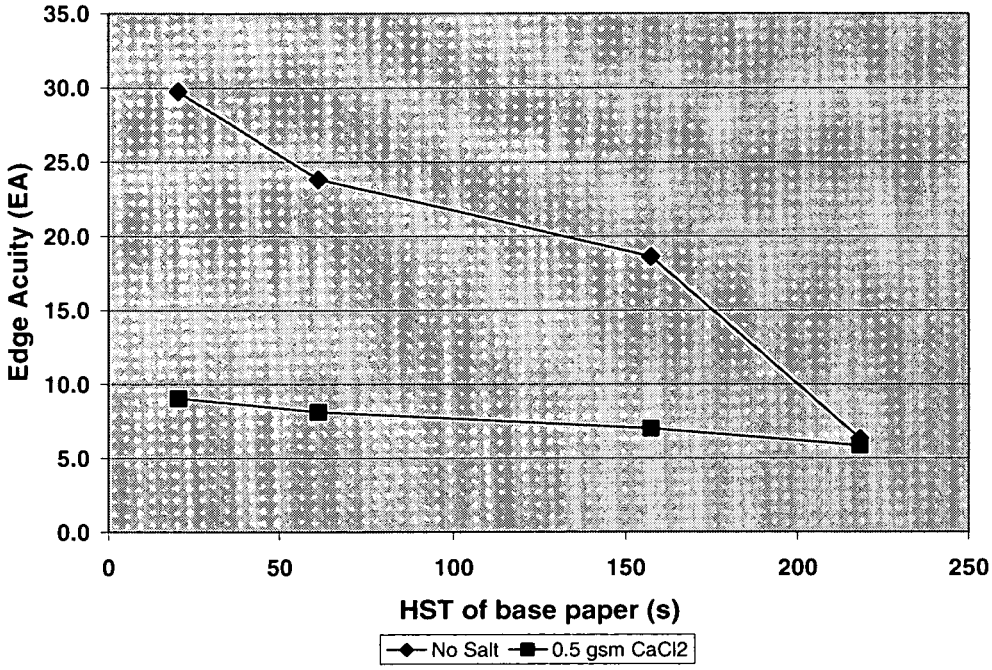
Figure 6. Edge Acuity (HP 6122) vs CaCl2 coverage
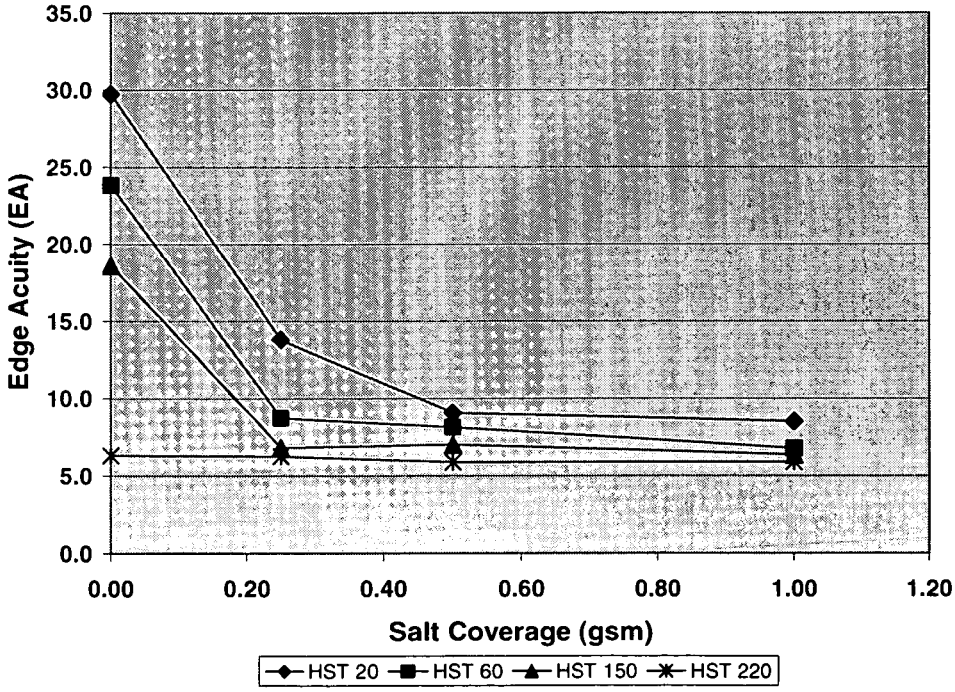

RECORDING SHEET WITH IMPROVED IMAGE DRY TIME

BACKGROUND OF THE INVENTION

1. Field of the Invention

This invention relates to recording sheets. More particularly, this invention relates to recording sheets having improved image dry time, and in particular to a paper based recording sheet, which is suitable as a recording sheet for use in any printing or recording process. While suitable for use in any printing process, the recording sheets of this invention are especially useful in ink jet printing processes.

2. Prior Art

Recording sheets for printing are known. See for example U.S. Pat. Nos. 6,207,258; 6,123,760; 6,162,328; 4,554,181; 4,381,185; 6,880,928; 6,207,258; 6,123,760; 6,162,328; 6,485,139; 6,686,054; 6,761,977; 6,764,726; and European Patent numbers EP0999937 and EP0999937.

SUMMARY OF THE INVENTION

One aspect of this invention is directed to a recording sheet for use in printing comprising a substrate which comprising ligno cellulosic fibers and a water soluble divalent metal salt preferably on at least one surface of the substrate; wherein the Hercules Sizing Test Value ("HST") of the substrate and the amount of divalent salt are selected such that the recording sheet has a percent ink transferred ("IT%") equal to or less than about 60. In the preferred embodiments of the invention, the water soluble divalent metal salt is in a mixture which also comprises one or more starches, one or more polymer emulsion additives, one or more nitrogen containing compounds, or a combination thereof.

The recording sheets of this invention exhibit one or more advantages over conventional printing recording sheets. For example, the recording sheets of this invention exhibit one or more improved image dry time properties. These improve properties include reduced ink transfer immediately after printing, improved image black density, and improved edge acuity when printed with pigment-based inks.

Still another aspect of this invention relates to a process of forming the recording sheet of this invention which comprises:

(a) applying a liquid composition comprising a volatile liquid such as water, methanol or the like having dissolved or dispersed therein one or more water soluble divalent metal salts, and one or more starches, one or more polymeric emulsion additives, one or more nitrogen containing compounds, or a combination thereof, to a surface of a substrate formed from ligno cellulosic fibers and having in contact with at least one surface of the substrate a water soluble divalent metal salt wherein the Hercules Sizing Test Value ("HST") of the substrate and the amount of divalent salt are selected such that the recording sheet has a percent ink transferred ("IT%") equal to or less than about 60 to form a wetted, treated substrate having said species or said mixture in contact with said surface; and (b) drying said surface of said wetted, treated substrate to form said recording sheet.

Yet another aspect of this invention relates to a method of generating images on a surface of a recording sheet in a printing apparatus which comprises:

(a) incorporating into said apparatus a recording sheet comprising a substrate which comprises ligno cellulosic fibers and a water soluble divalent metal salt, wherein the Hercules Sizing Test Value ("HST") of the substrate and the amount of divalent salt are selected such that the recording sheet has a percent ink transferred ("IT%") equal to or less than about 60; and (b) forming an image upon at least one surface of said recording sheet. In the preferred embodiments, the printing apparatus is an ink jet printer and the image is formed by causing ink to be expelled from said apparatus onto a surface of the recording sheet.

BRIEF DESCRIPTION OF THE DRAWINGS

The above and other aspects and advantages of the invention will now be further described in conjunction with the accompanying drawings in which:

FIG. 1 is a graph of Ink Transfer (%) versus HST of the Base Paper;

FIG. 2 is a graph of Ink Transfer (%) versus calcium chloride salt coverage (gsm);

FIG. 3 is a graph of black density ($OD_O$) versus HST of the Base Paper;

FIG. 4 is a graph of black density ($OD_O$) versus calcium chloride salt coverage (gsm);

FIG. 5 is a graph of edge acuity (EA) versus HST of the Base Paper; and

FIG. 6 is a graph of edge acuity (EA) versus calcium chloride salt coverage (gsm).

DETAILED DESCRIPTION OF THE INVENTION

This invention relates to a recording sheet for use in printing comprising a substrate formed from ligno cellulosic fibers and having in contact with at least one surface thereof a water soluble divalent metal salt. Applicants have surprisingly discovered that sizing level of the substrate, as measured by the HST of the substrate, and the amount of divalent metal salts on the surface of the substrate impact on image dry time of the recording sheet. The recording sheet of this invention exhibits enhanced image dry time as determined by the amount of ink transferred from a printed to an unprinted portion of the recording sheet after rolling with a roller of fixed weight. The "ink transfer", that is defined as the amount of optical density transferred after rolling with a roller; it is expressed as a percentage of the optical density transferred to the unprinted portion of the recording sheet after rolling with a roller. The method involves printing solid colored blocks on paper, waiting for a fixed amount of time, 5 seconds after printing, and then folding in half so that the printed portion contacts an unprinted portion of the recording sheet, and rolling with a 4.5 lb hand roller as for example roller item number HR-100 from Chem Instruments, Inc., Mentor, Ohio, USA. The optical density is read on the transferred ($OD_T$), the non-transferred ($OD_O$) portions of the block, and an un-imaged area ($OD_B$) by a reflectance densitometer (X-Rite, Macbeth. Etc.). The percent transferred ("IT%") is defined as $IT\%=[(OD_T-OD_B)/(OD_O-OD_B)]\times 100$.

The Hercules Sizing Test Value ("HST") of the substrate and the amount of divalent salt are selected such that the recording sheet has a percent ink transferred ("IT%") equal to or less than about 60. Preferably, the IT% is from 0% to about 50%. More preferably, the IT% is from 0% to about 40%. Most preferably, the IT% is from 0% to about 30%.

In addition to improved image dry time, some recording sheets of this invention preferably exhibit good print quality. As used herein, print quality (PQ) is measured by two important parameters: print density and edge acuity. Print density is measured using a reflectance densitometer (X-Rite, Macbeth. Etc.) in units of optical density ("OD"). The method involves printing a solid block of color on the sheet, and measuring the optical density. There is some variation in OD depending on the particular printer used and the print mode chosen, as well as the densitometer mode and color setting. The printer used in this patent is an HP Deskjet 6122, manufactured by Hewlett-Packard, which uses a #45 (HP product number 51645A) black ink jet cartridge. The print mode is determined by the type of paper and the print quality selected. For the data in this patent, the default setting of Plain Paper type and Fast Normal print quality print mode was selected. The densitometer used was an X-Rite model 528 spectrodensitometer with a 6 mm aperature. The density measurement settings were Visual color, status T, and absolute density mode. An increase in print density is usually seen when sufficient amounts of divalent water soluble metal salts are on the paper surface. In general, the target optical density for pigment black ("$OD_O$") is equal to or greater than 1.30 in the standard (plain paper, normal) print mode for the HP desktop ink jet printers that use the most common black pigment ink (equivalent to the #45 ink jet cartridge). Preferably, the $OD_O$ is equal to or greater than about 1.40. More preferably, the $OD_O$ is equal to or greater than about 1.50. Most preferably, the OD is equal to or greater than about 1.60.

Another parameter of recording sheets that is important to the determination of good print quality is the edge acuity ("EA"). Some recording sheets of this invention exhibit good edge acuity. Edge acuity is measured by an instrument such as the QEA Personal Image Analysis System (Quality Engineering Associates, Burlington, Mass.), the QEA ScannerIAS, or the ImageXpert KDY camera-based system. All of these instruments collect a magnified digital image of the sample and calculate an edge acuity value by image analysis. This value is also called edge raggedness, and is defined in ISO method 13660. The method involves printing a solid line 1.27 millimeters or more in length, sampling at a resolution of at least 600 dpi. The instrument calculates the location of the edge based on the darkness of each pixel near the line edges. The edge threshold is defined as the point of 60% transition from the substrate reflectance factor (light area, $R_{max}$) to the image reflectance factor (dark area, $R_{max}$) using the equation $R_{60}=R_{max}-60\%\ (R_{max}-R_{min})$. The edge raggedness is then defined as the standard deviation of the residuals from a line fitted to the edge threshold of the line, calculated perpendicular to the fitted line. The value of edge acuity is preferably less than about 15. Preferably, the EA is less than about 12. More preferably, the EA is less than about 10. Most preferably, the EA is less than about 8.

One essential component of the recording sheet of this invention is a substrate comprised of ligno cellulosic fibers. The type of fiber is not critical and any such fiber known for use in paper making can be used. For example, the substrate can made from pulp fibers derived from hardwood trees, softwood trees, or a combination of hardwood and softwood trees prepared for use in a papermaking furnish by any known suitable digestion, refining, and bleaching operations as for example known mechanical, thermomechanical, chemical and semichemical, etc., pulping and other well known pulping processes. The term "hardwood pulps" as used herein refers to fibrous pulp derived from the woody substance of deciduous trees (angiosperms) such as birch, oak, beech, maple, and eucalyptus, whereas "softwood pulps" are fibrous pulps derived from the woody substance of coniferous trees (gymnosperms) such as varieties of fir, spruce, and pine, as for example loblolly pine, slash pine, Colorado spruce, balsam fir and Douglas fir. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention. Recycled pulp fibers are also suitable for use. In a preferred embodiment, the cellulosic fibers in the paper include from about 30% to about 100% by weight dry basis softwood fibers and from about 70% to about 0% by weight dry basis hardwood fibers.

In addition to the ligno cellulosic fibers, the substrate may also include other conventional additives such as, for example, fillers, retention aids, wet strength resins and dry strength resins that may be incorporated into ligno cellulosic fiber based substrates. Among the fillers that may be used are inorganic and organic pigments such as, by way of example, minerals such as calcium carbonate, barium sulfate, titanium dioxide, calcium silicates, mica, kaolin and talc, and polymeric particles such as polystyrene latexes and polymethylmethacrylate. Other conventional additives include, but are not restricted to, alum, fillers, pigments and dyes.

The paper substrate may also include dispersed within the lingo cellulose fibers from expanded or unexpanded microspheres. Expanded and expandable microspheres are well known in the art. For example, suitable expandable microspheres are described in co-pending application Ser. Nos. 09/770,340 filed Jan. 26, 2001 and Ser. No. 10/121,301, filed Apr. 11, 2002; U.S. Pat. Nos. 3,556,934, 5,514,429, 5,125,996, 3,533,908, 3,293,114, 4,483,889, and 4,133,688; and UK Patent Application 2307487, the contents of which are incorporated by reference. All conventional microspheres can be used in the practice of this invention. Suitable microspheres include synthetic resinous particles having a generally spherical liquid-containing center. The resinous particles may be made from methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Preferred resinous particles comprise a polymer containing from about 65 to about 90 percent by weight vinylidene chloride, preferably from about 65 to about 75 percent by weight vinylidene chloride, and from about 35 to about 10 percent by weight acrylonitrile, preferably from about 25 to about 35 percent by weight acrylonitrile. Suitable expandable microspheres are available from Akzo Nobel of Marietta, Ga. under the trade name EXPANCEL. Expandable microspheres and their usage in paper materials are described in more detail in co-pending application Ser. No. 09/770,340 filed Jan. 26, 2001 and co-pending application Ser. No. 10/121,301, filed Apr. 11, 2002, the contents of which are incorporated by reference.

The Hercules Sizing Test Value ("HST") of the substrate may vary widely and is selected to provide the desired dry time characteristics. The HST value is measured following the conventions described in TAPPI Standard Method number T-530, using 1% formic acid ink and 80% reflectance endpoint. This test is commonly used for alkaline papers containing calcium carbonate filler, as noted in the TAPPI Journal article by S. R. Boone, February, 1996, pg 122. The HST of the substrate can be adjusted by the addition of a sizing agent to the substrate. It is preferred that the desired HST is obtained by internally sizing the substrate; that is, that sizing agents be added to the pulp suspension before it is converted to a paper web or substrate. Internal sizing helps prevent the surface size from soaking into the sheet, thus allowing it to remain on the surface where it has maximum effectiveness. The internal sizing agents for use in the practice of this invention encompass any of those commonly used at the wet end of a paper machine. These include rosin sizes, ketene dimers and multimers, and alkenylsuccinic anhydrides. The internal sizes are generally used at concentration levels known to art as for examples at levels of from about 0 wt. % to about 1.0 wt. % based on the weight of the dry paper sheet. More preferably, the internal size is used at levels of about 0.01% to about 0.5 wt. %. Most preferably, the internal size is used at levels of about 0.025% to about 0.25 wt. %. Methods and materials utilized for internal sizing with rosin are discussed by E. Strazdins in The Sizing of Paper, Second Edition, edited by W. F. Reynolds, TAPPI Press, 1989, pages 1-33. Suitable ketene dimers for internal sizing are disclosed in U.S. Pat. No. 4,279,794, which is incorporated by reference in its entirety, and in United Kingdom Patent Nos. 786,543; 903,416; 1,373,788 and 1,533,434, and in European Patent Application Publication No. 0666368 A3. Ketene dimers are commercially available, as Aquapel.RTM. and Precis.RTM. sizing agents from Hercules Incorporated, Wilmington, Del. Ketene multimers for use in internal sizes are described in European Patent Application Publication No. 0629741A1, corresponding to U.S. patent application Ser. No. 08/254,813, filed Jun. 6, 1994; European Patent Application Publication No. 0666368A3, corresponding to U.S. patent application Ser. No. 08/192,570, filed Feb. 7, 1994; and U.S. patent application Ser. No. 08/601,113, filed Feb. 16, 1996. Alkenyl succinic anhydrides for internal sizing are disclosed in U.S. Pat. No. 4,040,900, which in incorporated herein by reference in its entirety, and by C. E. Farley and R. B. Wasser in The Sizing of Paper, Second Edition, edited by W. F. Reynolds, TAPPI Press, 1989, pages 51-62. A variety of alkenylsuccinic anhydrides are commercially available from Albemarle Corporation, Baton Rouge, La.

As it is well known to those of ordinary skill in the art, the HST will vary directly with the basic weight of the substrate and other factors known to those of ordinary skill in the art as for example the amount and type of internal sizing agent as well as the type, amount, and surface area of filler, the ink used and the reflectance end point as specified in TAPPI T 530 Based upon the foregoing information, one of ordinary skill in the art can use conventional techniques and procedures to calculate, determine and/or estimate a particular HST for the substrate used to provide the desired image dry time characteristics. In the preferred embodiments of this invention, the HST value is preferably from about 1 second to about 400 seconds with 1% formic acid ink and 80% reflectance. The HST is more preferably from about 3 seconds to about 300 seconds and most preferably from about 5 seconds to about 200 seconds. In the embodiments of choice, the HST is from about 20 seconds to about 100 seconds.

The Gurley porosity of the base substrate is selected to provide the desired dry time characteristics. The Gurley porosity is measured by the procedure of TAPPI T460 om-88. In the preferred embodiments of this invention, the substrate has a Gurley porosity preferably from about 5 sec/100 ml to about 75 sec/100 ml. The Gurley porosity is more preferably from about 5 sec/100 ml to about 70 sec/100 ml and most preferably from about 5 sec/100 ml to about 50 sec/100 ml. In the embodiments of choice, the Gurley porosity is from about 10 sec/100 ml to about 35 sec/100 ml.

The pore diameter of the substrate is selected to provide the desired dry time characteristics. The pore diameter is measured by mercury intrusion porosimetry. In the preferred embodiments of this invention, the substrate has a pore diameter is preferably from about 2.0 to about 3.5. The pore diameter is more preferably from about 2.2 to about 3.3 and most preferably from about 2.4 to about 3.1. In the embodiments of choice, the pore diameter is from about 2.6 to about 3.0.

The substrate can be of any basis weight. Preferably, the substrate basis weight is from about 20 to about 500 g/m$^2$, although substrate basis weight can be outside of this range if desired. The basis weight is more preferably from about 20 to about 300 g/m$^2$ and most preferably from about 50 to about 200 g/m$^2$. In the embodiments of choice, the basis weight is from about 60 to about 120 g/m$^2$.

Suitable substrates can be purchased from commercial sources as for example International Paper Company of prepared by conventional techniques. Methods and apparatuses for preparing a substrate formed of ligno cellulosic fibers are well known in the paper and paperboard art. See for example "Handbook For Pulp & Paper Technologies", 2$^{nd}$ Edition, G. A. Smook, Angus Wilde Publications (1992) and references cited therein. Any conventional method and apparatus can be used. Preferably the process comprises: a) providing an aqueous suspension of ligno cellulosic fibers; b) sheeting and drying the aqueous ligno cellulosic fiber suspension to obtain dried paper web; c) drying the paper web to obtain dried paper web and d) calendering the dried paper web. In addition to these process steps, additional process steps known to those of ordinary skill in the art may be employed as for example a coating step to coat one or more surfaces of the web with a coating comprising a binder containing dispersant pigment.

The substrate contains an "effective amount" of the divalent water soluble metal salt preferably in contact with at least one surface of the substrate. As used herein, an "effective amount" is an amount which is sufficient to enhance the dry time of the substrate to any extent. This total amount of divalent water soluble metal salt in the substrate can vary widely, provided that the desired result is achieved. Usually, this amount is at least 0.02 g/m$^2$ although lower or higher amounts can be used. The amount of divalent water soluble metal salt is preferably from about 0.1 g/m$^2$ to about 3 g/m$^2$ and most preferably from about 0.2 g/m$^2$ to about 2.0 g/m$^2$. In the embodiments of choice, The amount of divalent water soluble metal salt is preferably from about 0.4 g/m$^2$ to about 1.5 g/m$^2$ Any divalent metal salt can be used in the practice of this invention. Suitable divalent water soluble metal salts include but are not limited to compounds containing calcium or magnesium. The counter ions may vary widely and include chloride, sulfate, nitrate, hydroxide and the like. Illustrative of such materials are calcium chloride, magnesium chloride, and calcium hydroxide. Preferred divalent water soluble metal salts for use in the practice of this invention are water soluble calcium salts, especially calcium chloride.

In the most preferred embodiments of this invention, a mixture comprising calcium chloride and one or more starches is in contact with at least one surface of the substrate. Illustrative of useful starches for the practice of this preferred embodiment of the invention are naturally occurring carbohydrates synthesized in corn, tapioca, potato and other plants by polymerization of dextrose units. All such starches and modified forms thereof such as starch acetates, starch esters, starch ethers, starch phosphates, starch xanthates, anionic starches, cationic starches, oxidized starches, and the like which can be derived by reacting the starch with a suitable chemical or enzymatic reagent can be used in the practice of this invention. Useful starches may be prepared by known techniques or obtained from commercial sources. For example, the suitable starches include Ethylex 2035 from A.E. Staley, PG-280 from Penford Products, oxidized corn starches from ADM, Cargill, and Raisio, and enzyme converted starches such as Amyzet 150 from Amylum.

Preferred starches for use in the practice of this invention are modified starches. More preferred starches are cationic modified chemically modified starches such as ethylated starches, oxidized starches, and AP and enzyme converted Pearl starches. Most preferred are chemically modified starches such as ethylated starches, oxidized starches, and AP and enzyme converted Pearl starches.

When the preferred divalent water soluble metal salt, calcium chloride, and the preferred Ethylex 2035 starch are used, the desired dry time of the sheet is obtained when the weight ratio of the calcium chloride to the starch is equal to or greater than about 5% to about 200%. In these embodiments, the weight ratio of the calcium chloride to the starch is preferably from about 5% to about 100%, more preferably from about 7% to about 70%, and most preferably from about 10% to about 40%.

In these preferred embodiments of the invention, the amount of the mixture of divalent water soluble metal salt and one or more starches on the surface of a substrate may vary widely and any conventional amount can be used. In general, the amount of the mixture in the substrate is at least about 0.02 $g/m^2$ of recording sheet, although higher and lower amounts can be used. The amount is preferably at least about 0.05 $g/m^2$, more preferably at least about 1.0 $g/m^2$ and most preferably from about 1.0 $g/m^2$ to about 4.0 $g/m^2$.

In addition to the required divalent metal salt, the mixture used to treat the substrate may include other ingredients in addition to the starch used in the preferred embodiments of the invention, including a pigment typically applied to the surface of a recording sheet in conventional amounts. Such optional components also include dispersants, surface sizing agents, optical brighteners, fluorescent dyes, surfactants, deforming agents, preservatives, pigments, binders, pH control agents, coating releasing agents, and the like.

Other optional components are nitrogen containing compounds. Suitable nitrogen containing organic species are compounds, oligomers and polymers are those containing one or more quaternary ammonium functional groups. Such functional groups may vary widely and include substituted and unsubstituted amines, imines, amides, urethanes, quaternary ammonium groups, dicyandiamides, guanides, and the like. Illustrative of such materials are polyamines, polyethyleneimines, copolymers of diallyldimethyl ammonium chloride (DADMAC), copolymers of vinyl pyrrolidone (VP) with quaternized diethylaminoethylmethacrylate (DEAMEMA), polyamides, cationic polyurethane latex, cationic polyvinyl alcohol, polyalkylamines dicyandiamid copolymers, amine glycigyl addition polymers, poly[oxyethylene (dimethyliminio) ethylene (dimethyliminio) ethylene]dichlorides, guanidine polymers, and polymeric biguanides. These types of compounds are well known, and are described in, for example, U.S. Pat. No. 4,554,181, U.S. Pat. No. 6,485,139, U.S. Pat. No. 6,686,054, U.S. Pat. No. 6,761,977, and U.S. Pat. No. 6,764,726.

Preferred nitrogen containing organic species for use in the practice of this invention are low to medium molecular weight cationic polymers and oligomers having a molecular weight equal to or less than 100,000, preferably equal to or less than about 50,000 and more preferably from about 10,000 to about 50,000. Illustrative of such materials are polyalkylamine dicyandiamide copolymers, poly [oxyethylene (dimethyliminio ethylene (dimethyliminioethylene]dichlorides and polyamines having molecular weights within the desired range. More preferred nitrogen containing organic species for use in the practice of this invention are low molecular weight cationic polymers such as polyalkylamine dicyandiamid copolymer, poly [oxyethylene (dimethyliminio) ethylene (dimethyliminio) ethylene]dichloride, guanidine polymers, and polymeric biguanides. Most preferred nitrogen containing organic species for use in the practice of this invention are low molecular weight polyalkylamine dicyandiamid copolymers, guanidine polymers, and polymeric biguanides such as polyhexamethylenebiguanide.

The recording sheet of this invention can be prepared using known conventional techniques. For example, the essential one or more divalent water soluble metal salt preferably admixed with one or more starches, and one or more optional components can be dissolved or dispersed in an appropriate liquid medium, preferably water, and can be applied to the substrate by any suitable technique, such as a size press treatment, dip coating, reverse roll coating, extrusion coating or the like. Such coating techniques are well known in the art and will not be described in any great detail.

For example, the coating can be applied with conventional size press equipment having vertical, horizontal or inclined size press configurations conventional used in paper preparation as for example the Symsizer (Valmet) type equipment, a KRK size press (Kumagai Riki Kogyo Co., Ltd., Nerima, Tokyo, Japan) by dip coating. The KRK size press is a lab size press that simulates a commercial size press. This size press is normally sheet fed, whereas a commercial size press typically employs a continuous web.

In dip treating, a web of the material to be treated is transported below the surface of the liquid coating composition by a single roll in such a manner that the exposed site is saturated, followed by removal of any excess treating mixture by the squeeze rolls an drying at 100° C. in an air dryer. The liquid treating composition generally comprises the desired treating composition dissolved in a solvent such as water, methanol, or the like. The method of surface treating the substrate using a coater results in a continuous sheet of substrate with the treating material applied first to one side and then to the second side of this substrate. The substrate can also be treated by a slot extrusion process, wherein a flat die is situated with the die lips in close proximity to the web of substrate to be treated, resulting in a continuous film of the treating solution evenly distributed across one surface of the sheet, followed by drying in an air dryer at a suitable drying temperature as for example 100° C.

The recording sheet of this invention can be printed by generating images on a surface of the recording sheet using conventional printing processes and apparatus as for example laser, Ink jet, offset and flexo printing processes and apparatus. In this method, the recording sheet of this invention is incorporated into a printing apparatus; and an image is formed on a surface of the sheet. The recording sheet of this invention is preferably printed with ink jet printing processes and apparatus as for example desk top ink jet printing and high speed commercial ink jet printing. One preferred embodiment of the present invention is directed to ink jet printing process which comprises applying an aqueous recording liquid to a recording sheet of the present invention in an image wise pattern. Another embodiment of the present invention is directed to ink jet printing process which comprises (1) incorporating into an ink jet printing apparatus containing an aqueous ink a recording sheet of the present invention, and (2) causing droplets of the ink to be ejected in an image wise pattern onto the recording sheet, thereby generating images on the recording sheet. Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530. In a particularly preferred embodiment, the ink jet printing apparatus employs a thermal ink jet process wherein the ink in the nozzles is selectively heated in an imagewise pattern, thereby causing droplets of the ink to be ejected in imagewise pattern. The recording sheets of the present invention can also be used in any other printing or imaging process, such as printing with pen plotters, imaging with color laser printers or copiers, handwriting with ink pens, offset printing processes, or the like, provided that the toner or ink employed to form the image is compatible with the ink receiving layer of the recording sheet. The present invention will be described with references to the following examples. The examples are intended to be illustrative and the invention is not limited to the materials, conditions, or process parameters set forth in the example. All parts and percentages are by unit weight unless otherwise indicated.

Example 1

(A) Preparation of Lab Drawdown Compositions

A series of coating composition were prepared using the following procedure. The coating is prepared in the lab using a low shear mixer. A certain amount of water is added to the coating container, and then anhydrous calcium chloride (94-97%, Mini pellets from the Dow Chemical Co., Midland, Mich., and USA.) is added under proper shear actions until dissolved. The coating compositions and specifications are set for the in the following Table 1.

TABLE 1

| Compositions | | |
|---|---|---|
| Composition | Calcium Chloride, Parts | Water, Parts |
| 1 | 2.5 | 97.5 |
| 2 | 5 | 95 |
| 3 | 10 | 90 |

B. Preparation of Treated Substrates

Several commercially available base papers a basis weight of about 75 g/m$^2$ and HST values ranging from about 20 seconds to about 220 seconds were coated with the coating compositions of Table 1. The base sheets and there specifications are set forth in the following Table 2.

TABLE 2

| Base paper | | |
|---|---|---|
| Base Paper | Commercial Name | Sizing Level (HST, s) |
| A | Office Max MaxBrite | 20 |
| B | Xerox Premium Multipurpose | 61 |
| C | Hewlett Packard Multipurpose | 157 |
| D | Hewlett Packard Everday Ink Jet | 218 |

To apply the coating formulation, both ends of a 9"×12" sheet of base paper are taped to a backing sheet, the coating composition is applied in a thin line above the paper substrate, and a Meyer rod is drawn down the sheet in a uniform manner. By controlling the compositions solids and rod size, a pickup weight of 0.25 to 1.0 g/m$^2$ per side is achieved. The coated substrates and their specifications are set forth in the following Table 3.

TABLE 3

| Treated Substrates | | | |
|---|---|---|---|
| Treated Substrate | Composition | Base Paper | Salt Coverage, (gsm) |
| 1A | 1 | A | 0.25 |
| 1B | 1 | B | 0.25 |
| 1C | 1 | C | 0.25 |
| 1D | 1 | D | 0.25 |
| 2A | 2 | A | 0.5 |
| 2B | 2 | B | 0.5 |
| 2C | 2 | C | 0.5 |
| 2D | 2 | D | 0.5 |
| 3A | 3 | A | 1.0 |
| 3B | 3 | B | 1.0 |
| 3C | 3 | C | 1.0 |
| 4D | 3 | D | 1.0 |

Example 2

A series of experiments were carried out to evaluate the suitability of the substrates of Table 3 for use in ink printing. The properties selected for evaluation were drying time, print density and edge acuity. For comparison purposes, the same properties were evaluate for Base Papers A, B, C and D. The procedures used are as follows:

A. Dry Time ("IT%"):

In this evaluation, paper samples were imaged with a Hewlett-Packard Deskjet 6122, manufactured by Hewlett-Packard, using a (HP product number 51645A) black ink jet cartridge under TAPPI room condition (23° C. and 50% RH). The print mode is determined by the type of paper and the print quality selected. The printer default setting of Plain Paper type and Fast Normal print quality print mode was selected. The densitometer used was an X-Rite model 528 spectrodensitometer with a 6 mm aperature. The density measurement settings were Visual color, status T, and absolute density mode. After waiting 5 seconds after printing, the samples were folded in half and rolled with a 4.5 kg rubber hand roller, item number HR-100 from ChemInstruments, Inc., Mentor, Ohio, USA. The samples were then unfolded and allowed to air dry. The densities of the samples were measured with an X-Rite 500 series densitometer to indicate the density before ($OD_O$) and after ($OD_T$) rolling. An unprinted area was also measured to obtain a value for the paper background ($OD_B$). The percent transferred ("IT%") for the various papers is then calculated using the following equation:

$$IT\% = [(OD_T - OD_B)/(OD_O - OD_B)] \times 100.$$

B. Print Density ("$OD_O$")

In this evaluation, paper samples were imaged with a Hewlett-Packard Deskjet 6122, manufactured by Hewlett-Packard, using a (HP product number 51645A) black ink jet cartridge under TAPPI room condition (23° C. and 50% RH). The print mode is determined by the type of paper and the print quality selected. The printer default setting of Plain Paper type and Fast Normal print quality print mode was selected. The samples were then allowed to air dry. The densities of the samples were measured with an X-Rite model 528 spectrodensitometer with a 6 mm aperature. The density measurement settings were Visual color, status T, and absolute density mode.

C. Edge Acuity ("EA"):

In this evaluation, paper samples were imaged with a Hewlett-Packard Deskjet 6122, manufactured by Hewlett-Packard, using a (HP product number 51645A) black ink jet cartridge under TAPPI room condition (23° C. and 50% RH). The print mode is determined by the type of paper and the print quality selected. The printer default setting of Plain Paper type and Fast Normal print quality print mode was selected. The samples were then allowed to air dry. The edge acuity of the samples were measured with a QEA Personal Image Analysis System (Quality Engineering Associates, Burlington, Mass.).

The results of these evaluations are set forth in the following Table 4 and FIGS. 1 to 6.

TABLE 4

| Treated Substrate | IT % | $OD_O$ | EA | HST (s) | Salt Coverage (gsm) |
|---|---|---|---|---|---|
| 1A | 4 | 1.62 | 13.8 | 20 | 0.25 |
| 1B | 20 | 1.68 | 8.7 | 61 | 0.25 |
| 1C | 59 | 1.63 | 6.8 | 157 | 0.25 |
| 1D | 58 | 1.63 | 6.3 | 218 | 0.25 |
| 2A | 3 | 1.61 | 9.1 | 20 | 0.5 |
| 2B | 18 | 1.65 | 8.1 | 61 | 0.5 |
| 2C | 43 | 1.64 | 7.0 | 157 | 0.5 |
| 2D | 71 | 1.62 | 5.9 | 218 | 0.5 |
| 3A | 4 | 1.61 | 8.5 | 20 | 1.0 |
| 3B | 27 | 1.64 | 6.8 | 61 | 1.0 |
| 3C | 49 | 1.62 | 6.4 | 157 | 1.0 |
| 3D | 68 | 1.59 | 5.9 | 218 | 1.0 |
| Base Paper A | 1 | 1.06 | 29.7 | 20 | 0 |
| Base Paper B | 46 | 1.31 | 18.6 | 61 | 0 |
| Base Paper C | 76 | 1.43 | 23.8 | 157 | 0 |
| Base Paper D | 87 | 1.51 | 6.3 | 218 | 0 |

Example 3

(A) Preparation of Size Press Compositions

A series of coating compositions were prepared using the following procedure. The coating is prepared in the lab using a low shear mixer. A certain amount of pre-cooked starch is added to the coating container, then the water and then the water soluble divalent metal salt under proper shear actions. Then 0.6 parts of a styrene-based surface sizing agent was added to the coating under shear. The desired coating solids for this application is in a range of 11 to 16% depending on the tolerance of the system to coating or size press treatment viscosity, and the desired pickup. The coating compositions and specifications are in the following Table 5.

TABLE 5

| Size Press Compositions | | | |
|---|---|---|---|
| Size Press Composition | Ethylated Starch, Parts | Calcium Chloride, Parts | Water, Parts |
| 1 | 11 | 0 | 89 |
| 2 | 11 | 1 | 88 |
| 3 | 11 | 2 | 87 |
| 4 | 12 | 3 | 85 |
| 5 | 12 | 4 | 84 |

(B) Preparation of Size Press Treated Ink Jet Paper

1. Substrate Preparation

The substrates used in this experiment were made on a paper machine from a fiber furnish consisting of 60% softwood and 40% eucalyptus fibers and 15% precipitated calcium carbonate with alkenyl succinic anhydride (ASA) internal size. The basis weight of the substrate paper was about 75 g/m$^2$ and HST value of about 20 seconds.

2. Size Press Treatment

The base paper used in this procedure has a basis weight of about 75 g/m$^2$ and an HST value of about 20 seconds. To apply the coating formulation, a 12" wide roll of paper substrate is continuously fed between two rollers, and the coating formulation is pumped into the nip reservoir, the paper being fed through the nip reservoir at a prefixed speed. By controlling the formulation solids, nip pressure, and size press running speed, a pickup weight of about 2.2 to 3.0 g/m$^2$ is achieved.

The size press treated substrates and their specifications are set forth in the following Table 6.

TABLE 6

| Size Press Treated Substrates | | | |
|---|---|---|---|
| Size Press Treated Substrate | Size Press Composition | Starch Coverage, (gsm) | Salt Coverage, (gsm) |
| 1 | 1 | 2.2 | 0 |
| 2 | 2 | 2.2 | 0.2 |
| 3 | 3 | 2.2 | 0.4 |
| 4 | 4 | 2.2 | 0.6 |
| 5 | 5 | 2.2 | 0.8 |

Using the procedures of Example 2, the IT%, $OD_O$ and EA of the size press treated substrates of Table 6 were determined. The results of these evaluations are set forth in the following Table 7.

TABLE 7

| Size Press Treated Substrate | IT % | $OD_O$ | EA | HST (s) | Salt Coverage (gsm) |
|---|---|---|---|---|---|
| 1 | 70 | 1.24 | 9.1 | 57 | 0 |
| 2 | 42 | 1.56 | 7.7 | 47 | 0.2 |
| 3 | 28 | 1.57 | 8.1 | 47 | 0.4 |
| 4 | 31 | 1.60 | 7.4 | 58 | 0.6 |
| 5 | 30 | 1.51 | 6.9 | 47 | 0.8 |

Example 4

(A) Preparation of Size Press Treated Compositions

A series of coating compositions were prepared using the following procedure. The coating ingredients such as pre-cooked starch, water soluble divalent metal salt, water, various coating additives such as optical brighteners, defoamers, cationic polymers, sizing agents, and crosslinkers are continuously fed into the size press run tanks of the paper machine with mixing. The desired coating solids for this application is in a range of 5 to 25% depending on the tolerance of the system to coating or size press treatment viscosity. The size press compositions and specifications are set for the in the following Table 8.

TABLE 8

| Size Press Compositions | | | | |
|---|---|---|---|---|
| Size Press Composition | Ethylated Starch, Parts | Calcium Chloride, Parts | Cationic Polymer, Parts | Water, Parts |
| 1 | 8 | 0 | 0 | 92 |
| 2 | 8 | 2.5 | 0 | 89.5 |
| 3 | 6 | 2.5 | 3.5 | 88 |

(B) Preparation of Size Press Treated Ink Jet Paper

1. Substrate Preparation

The substrates used in this experiment were made on a paper machine from a fiber furnish consisting of 60% softwood and 40% eucalyptus fibers and 15% precipitated calcium carbonate with alkenyl succinic anhydride (ASA) internal size. The basis weight of the substrate paper was about 75 g/m$^2$ and HST values ranging from about 30 seconds to about 150 seconds.

2. Machine Trials

To apply the size press formulation, the ingredients are pumped into a stainless steel mixing tank at a predetermined rate, and metered onto the paper substrate using a rod-metered or puddle size press. By controlling the formulation solids and nip pressure, a pickup weight of about 3.0 g/m$^2$ is achieved.

The size press treated substrates and their specifications are set forth in the following Table 9.

TABLE 9

Size press Treated Substrates

| Size Press Treated Substrate | Size Press Composition | Salt Coverage, (gsm) |
|---|---|---|
| 1 | 1 | 0 |
| 2 | 2 | 0.8 |
| 3 | 2 | 0.8 |
| 4 | 2 | 0.8 |
| 5 | 3 | 1.0 |

Using the procedures of Example 2, the IT%, $OD_O$ and EA of the size press treated substrates of Table 9 were determined. The results of these evaluations are set forth in the following Table 10.

TABLE 10

| Coated Substrate | IT % | $OD_O$ | EA | HST (s) | Salt Coverage (gsm) |
|---|---|---|---|---|---|
| 1 | 71 | 1.30 | 9.7 | 118 | 0 |
| 2 | 36 | 1.54 | 7.2 | 139 | 0.8 |
| 3 | 27 | 1.52 | 7.5 | 121 | 0.8 |
| 4 | 11 | 1.53 | 8.8 | 48 | 0.8 |
| 5 | 17 | 1.58 | 7.0 | 24 | 1.0 |

Finally, variations from the examples given herein are possible in view of the above-disclosure. Therefore, although the invention has been described with reference to certain preferred embodiments, it will be appreciated that other compositions may be devised, which are nevertheless within the scope and spirit of the invention as defined in the claims appended hereto. The foregoing description of various and preferred embodiments of the present invention has been provided for purposes of illustration only, and it is understood that numerous modifications, variations and alterations may be made thereto without departing from the spirit or scope of the invention as set forth in the following claims.

What is claimed is:

1. A recording sheet, comprising:

a substrate comprising ligno cellulosic fibers and having a Hercules Sizing Test Value ("HST") of from about 20 seconds to about 220 seconds, and from about 0.25 g/m$^2$ to 1.0 g/m$^2$ of calcium chloride in contact with at least one surface of said substrate, wherein when the recording sheet is printed on with black ink it has a percent ink transferred ("IT %") in the range of from 3 to 71, an edge acuity ("EA") in the range of from 5.9 to 13.8, and an optical density for pigment black ("$OD_O$") in the range of from 1.59 to 1.68.

2. The recording sheet of claim 1 wherein said ligno cellulosic fibers comprise a mixture of hardwood and softwood pulp fibers.

3. The recording sheet of claim 1 wherein said substrate has a Gurley porosity of from about 5 sec/100 ml to about 75 sec/100 ml.

4. The recording sheet of claim 1 wherein said substrate has a pore diameter of from about 2.0 to about 3.5.

5. The recording sheet of claim 1 wherein said HST is from about 20 seconds to about 100 seconds.

6. The recording sheet of claim 1 wherein the percent ink transferred ("IT %") is in the range of from 3 to 50.

7. The recording sheet of claim 6 wherein the percent ink transferred ("IT %") is in the range of from 3 to 40.

8. The recording sheet of claim 7 wherein the percent ink transferred ("IT %") is in the range of from 3 to 30.

9. The recording sheet of claim 8 wherein the percent ink transferred ("IT %") is in the range of from 3 to 20.

10. The recording sheet of claim 1 wherein the edge acuity ("EA") is in the range of from 5.9 to less than about 12.

11. The recording sheet of claim 1 wherein the edge acuity ("EA") is in the range of from 5.9 to less than about 10.

12. The recording sheet of claim 11 wherein the edge acuity ("EA") is in the range of from 5.9 to less than about 8.

13. The recording sheet of claim 1 having a mixture of calcium chloride and at least one of one or more starches, one or more polymeric emulsion additives, one or more nitrogen containing compounds, or a combination thereof on a surface of the substrate.

14. The recording sheet of claim 1, further comprising one or more starches in contact with the at least one surface of said substrate.

15. A recording sheet, comprising:

a substrate comprising ligno cellulosic fibers and having a Hercules Sizing Test Value ("HST") of from 47 seconds to 58 seconds; and from 0.2 g/m$^2$ to 0.8 g/m$^2$ of calcium chloride in contact with at least one surface of said substrate; and one or more starches in contact with the at least one surface of said substrate, wherein the one or more starches include ethylated starch;

wherein when the recording sheet is printed on with black ink it has a percent ink transferred ("IT %") equal to or less than about 50, an edge acuity ("EA") in the range of from 6.9 to 8.1, and an optical density for pigment black ("$OD_O$") in the range of from 1.50 to 1.60.

16. The recording of claim 14, wherein said one or more starches comprises carbohydrates synthesized in tapioca by polymerization of dextrose units.

* * * * *